US007173385B2

(12) United States Patent
Caporaso et al.

(10) Patent No.: US 7,173,385 B2
(45) Date of Patent: Feb. 6, 2007

(54) COMPACT ACCELERATOR

(75) Inventors: George J. Caporaso, Livermore, CA (US); Stephen E. Sampayan, Manteca, CA (US); Hugh C. Kirbie, Los Alamos, NM (US)

(73) Assignee: The Regents of the University of California, Oakland, CA (US)

( * ) Notice: Subject to any disclaimer, the term of this patent is extended or adjusted under 35 U.S.C. 154(b) by 191 days.

(21) Appl. No.: 11/036,431

(22) Filed: Jan. 14, 2005

(65) Prior Publication Data

US 2005/0184686 A1 Aug. 25, 2005

Related U.S. Application Data

(60) Provisional application No. 60/536,943, filed on Jan. 15, 2004.

(51) Int. Cl.
*H05H 9/00* (2006.01)

(52) U.S. Cl. ..... 315/505; 315/500; 315/507

(58) Field of Classification Search ..... 315/5.41, 315/5.42, 5.47, 500, 505, 507; 328/233
See application file for complete search history.

(56) References Cited

U.S. PATENT DOCUMENTS

| | | | | |
|---|---|---|---|---|
| 2,465,840 A | | 3/1949 | Blumiein et al. | 333/20 |
| 4,888,556 A | * | 12/1989 | Buttram et al. | 315/505 |
| 5,757,146 A | | 5/1998 | Carder | 315/505 |
| 5,811,944 A | * | 9/1998 | Sampayan et al. | 315/505 |
| 5,821,705 A | * | 10/1998 | Caporaso et al. | 315/507 |

* cited by examiner

*Primary Examiner*—Tuyet Vo
*Assistant Examiner*—Jimmy Vu
(74) *Attorney, Agent, or Firm*—James S. Tak

(57) ABSTRACT

A compact linear accelerator having at least one strip-shaped Blumlein module which guides a propagating wavefront between first and second ends and controls the output pulse at the second end. Each Blumlein module has first, second, and third planar conductor strips, with a first dielectric strip between the first and second conductor strips, and a second dielectric strip between the second and third conductor strips. Additionally, the compact linear accelerator includes a high voltage power supply connected to charge the second conductor strip to a high potential, and a switch for switching the high potential in the second conductor strip to at least one of the first and third conductor strips so as to initiate a propagating reverse polarity wavefront(s) in the corresponding dielectric strip(s).

26 Claims, 6 Drawing Sheets

COMPACT ACCELERATOR

I. CLAIM OF PRIORITY IN PROVISIONAL APPLICATION

This application claims priority in provisional application no. 60/536,943, filed on Jan. 15, 2004, entitled "Improved Compact Accelerator" by George J. Caporaso et al.

The United States Government has rights in this invention pursuant to Contract No. W-7405-ENG-48 between the United States Department of Energy and the University of California for the operation of Lawrence Livermore National Laboratory.

II. FIELD OF THE INVENTION

The present invention relates to linear accelerators and more particularly to dielectric wall accelerators and pulse-forming lines that operate at high gradients to feed an accelerating pulse down an insulating wall.

III. BACKGROUND OF THE INVENTION

Particle accelerators are used to increase the energy of electrically-charged atomic particles, e.g., electrons, protons, or charged atomic nuclei, so that they can be studied by nuclear and particle physicists. High energy electrically-charged atomic particles are accelerated to collide with target atoms, and the resulting products are observed with a detector. At very high energies the charged particles can break up the nuclei of the target atoms and interact with other particles. Transformations are produced that tip off the nature and behavior of fundamental units of matter. Particle accelerators are also important tools in the effort to develop nuclear fusion devices, as well as for medical applications such as cancer therapy.

One type of particle accelerator is disclosed in U.S. Pat. No. 5,757,146 to Carder, incorporated by reference herein, for providing a method to generate a fast electrical pulse for the acceleration of charged particles. In Carder, a dielectric wall accelerator (DWA) system is shown consisting of a series of stacked circular modules which generate a high voltage when switched. Each of these modules is called an asymmetric Blumlein, which is described in U.S. Pat. No. 2,465,840 incorporated by reference herein. As can be best seen in FIGS. 4A–4B of the Carder patent, the Blumlein is composed of two different dielectric layers. On each surface and between the dielectric layers are conductors which form two parallel plate radial transmission lines. One side of the structure is referred to as the slow line, the other is the fast line. The center electrode between the fast and slow line is initially charged to a high potential. Because the two lines have opposite polarities there is no net voltage across the inner diameter (ID) of the Blumlein. Upon applying a short circuit across the outside of the structure by a surface flashover or similar switch, two reverse polarity waves are initiated which propagate radially inward towards the ID of the Blumlein. The wave in the fast line reaches the ID of the structure prior to the arrival of the wave in the slow line. When the fast wave arrives at the ID of the structure, the polarity there is reversed in that line only, resulting in a net voltage across the ID of the asymmetric Blumlein. This high voltage will persist until the wave in the slow line finally reaches the ID. In the case of an accelerator, a charged particle beam can be injected and accelerated during this time. In this manner, the DWA accelerator in the Carder patent provides an axial accelerating field that continues over the entire structure in order to achieve high acceleration gradients.

The existing dielectric wall accelerators, such as the Carder DWA, however, have certain inherent problems which can affect beam quality and performance. In particular, several problems exist in the disc-shaped geometry of the Carder DWA which make the overall device less than optimum for the intended use of accelerating charged particles. The flat planar conductor with a central hole forces the propagating wavefront to radially converge to that central hole. In such a geometry, the wavefront sees a varying impedance which can distort the output pulse, and prevent a defined time dependent energy gain from being imparted to a charged particle beam traversing the electric field. Instead, a charged particle beam traversing the electric field created by such a structure will receive a time varying energy gain, which can prevent an accelerator system from properly transporting such beam, and making such beams of limited use.

Additionally, the impedance of such a structure may be far lower than required. For instance, it is often highly desirable to generate a beam on the order of milliamps or less while maintaining the required acceleration gradients. The disc-shaped Blumlein structure of Carder can cause excessive levels of electrical energy to be stored in the system. Beyond the obvious electrical inefficiencies, any energy which is not delivered to the beam when the system is initiated can remain in the structure. Such excess energy can have a detrimental effect on the performance and reliability of the overall device, which can lead to premature failure of the system.

And inherent in a flat planar conductor with a central hole (e.g. disc-shaped) is the greatly extended circumference of the exterior of that electrode. As a result, the number of parallel switches to initiate the structure is determined by that circumference. For example, in a 6" diameter device used for producing less than a 10 ns pulse typically requires, at a minimum, 10 switch sites per disc-shaped asymmetric Blumlein layer. This problem is further compounded when long acceleration pulses are required since the output pulse length of this disc-shaped Blumlein structure is directly related to the radial extent from the central hole. Thus, as long pulse widths are required, a corresponding increase in switch sites is also required. As the preferred embodiment of initiating the switch is the use of a laser or other similar device, a highly complex distribution system is required. Moreover, a long pulse structure requires large dielectric sheets for which fabrication is difficult. This can also increase the weight of such a structure. For instance, in the present configuration, a device delivering 50 ns pulse can weigh as much as several tons per meter. While some of the long pulse disadvantages can be alleviated by the use of spiral grooves in all three of the conductors in the asymmetric Blumlein, this can result in a destructive layer-to-layer coupling which can inhibit the operation. That is, a significantly reduced pulse amplitude (and therefore energy) per stage can appear on the output of the structure.

Therefore there is a need for an improved geometry and structure for a linear particle accelerator which similarly uses the Blumlein concept, but has the ability to control the pulse shape and thereby impart a defined time dependent energy gain to a charged particle beam traversing the electric field.

IV. SUMMARY OF THE INVENTION

One aspect of the present invention includes a compact linear accelerator, comprising: a Blumlein module having a first planar conductor strip having a first end connected to a ground potential, and a second end adjacent an acceleration axis; a second planar conductor strip adjacent to and parallel with the first planar conductor strip, said second planar conductor strip having a first end switchable between the ground potential and a high voltage potential and a second end adjacent the acceleration axis; a third planar conductor strip adjacent to and parallel with the second planar conductor strip, said third planar conductor strip having a first end connected to a ground potential and a second end adjacent the acceleration axis; a first dielectric strip that fills the space between the first and second planar conductor strips, and comprising a first dielectric material with a first dielectric constant; and a second dielectric strip that fills the space between the second and third planar conductor strips, and comprising a second dielectric material with a second dielectric constant, wherein the strip configuration of the Blumlein module guides an electrical signal wave propagated therethrough from the first end to the second end in order to control an output pulse produced at the second end.

Another aspect of the present invention includes a compact linear accelerator, comprising: a Blumlein module having: a first planar conductor strip having a first end connected to a ground potential, and a second end adjacent an acceleration axis; a second planar conductor strip adjacent to and parallel with the first planar conductor strip, said second planar conductor strip having a first end switchable between the ground potential and a high voltage potential and a second end adjacent the acceleration axis; a third planar conductor strip adjacent to and parallel with the second planar conductor strip, said third planar conductor strip having a first end connected to a ground potential and a second end adjacent the acceleration axis; a first dielectric strip that fills the space between the first and second planar conductor strips, and comprising a first dielectric material with a first dielectric constant; and a second dielectric strip that fills the space between the second and third planar conductor strips, and comprising a second dielectric material with a second dielectric constant; high voltage power supply means connected to charge said second planar conductor strip to a high potential; and switching means for switching the high potential in the second planar conductor strip to at least one of the first and third planar conductor strips so as to initiate a propagating reverse polarity wavefront(s) in the corresponding dielectric strip(s), wherein the strip configuration of the Blumlein module guides an electrical signal wave propagated therethrough from the first end to the second end in order to control an output pulse produced at the second end.

V. BRIEF DESCRIPTION OF THE DRAWINGS

The accompanying drawings, which are incorporated into and form a part of the disclosure, are as follows.

VI. DETAILED DESCRIPTION

Figure 1:
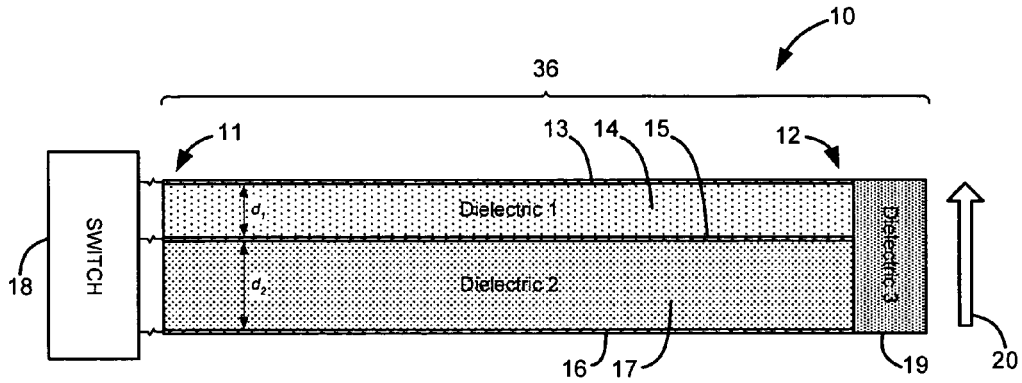
FIG. 1 is a side view of a first exemplary embodiment of a single Blumlein module of the compact accelerator of the present invention.
Figure 2:
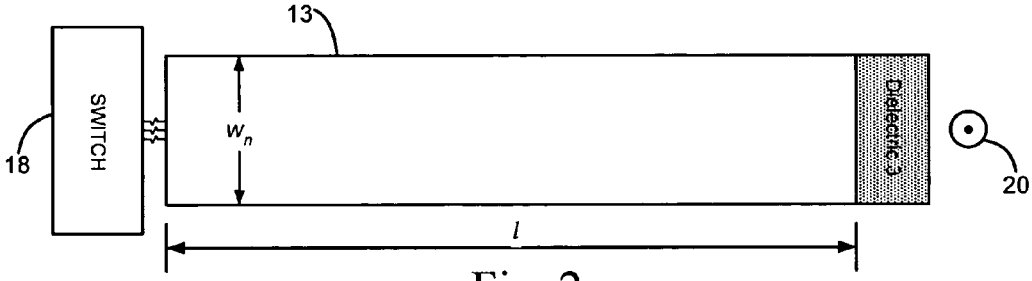
FIG. 2 is top view of the single Blumlein module of FIG. 1.
Figure 6:
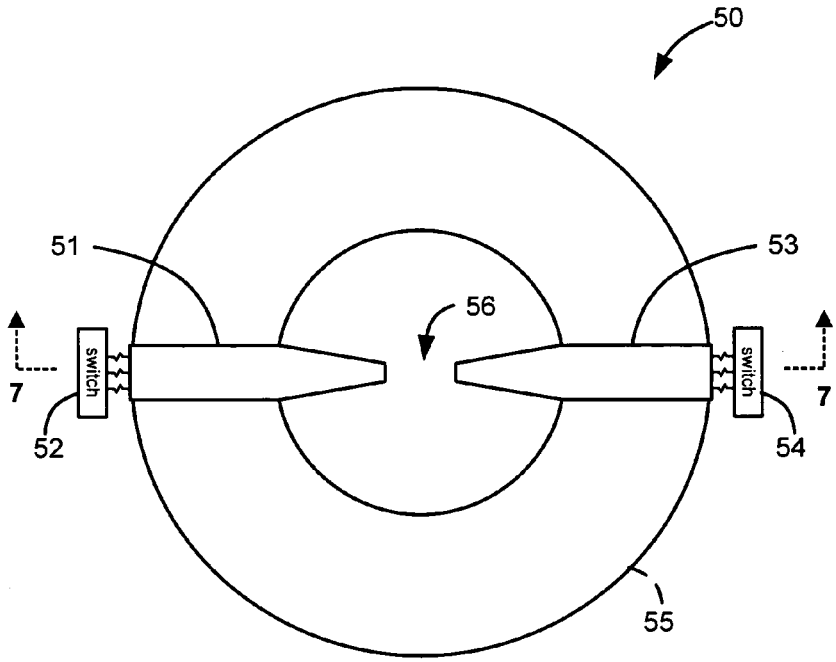
FIG. 6 is a plan view of another exemplary embodiment of the compact accelerator shown with two Blumlein modules perimetrically surrounding and radially extending towards a central acceleration region.

Turning now to the drawings, FIGS. 1–2 show a first exemplary embodiment of the compact linear accelerator of the present invention, generally indicated at reference character 10, and comprising a single Blumlein module 36 connected to a switch 18. The compact accelerator also includes a suitable high voltage supply (not shown) providing a high voltage potential to the Blumlein module 36 via the switch 18. Generally, the Blumlein module has a strip configuration, i.e. a long narrow geometry, typically of uniform width but not necessarily so. The particular Blumlein module 11 shown in FIGS. 1 and 2 has an elongated beam or plank-like linear configuration extending between a first end 11 and a second end 12, and having a relatively narrow width, $w_n$ (FIGS. 2, 4) compared to the length, l. This strip-shaped configuration of the Blumlein module operates to guide a propagating electrical signal wave from the first end 11 to the second end 12, and thereby control the output pulse at the second end. In particular, the shape of the wavefront may be controlled by suitably configuring the width of the module, e.g. by tapering the width as shown in FIG. 6. The strip-shaped configuration enables the compact accelerator of the present invention to overcome the varying impedance of propagating wavefronts which can occur when radially directed to converge upon a central hole as discussed in the Background regarding disc-shaped module of Carder. And in this manner, a flat output (voltage) pulse can be produced by the strip or beam-like configuration of the module 10 without distorting the pulse, and thereby prevent a particle beam from receiving a time varying energy gain. As used herein and in the claims, the first end 11 is characterized as that end which is connected to a switch, e.g.

switch 18, and the second end 12 is that end adjacent a load region, such as an output pulse region for particle acceleration.

As shown in FIGS. 1 and 2, the narrow beam-like structure of the basic Blumlein module 10 includes three planar conductors shaped into thin strips and separated by dielectric material also shown as elongated but thicker strips. In particular, a first planar conductor strip 13 and a middle second planar conductor strip 15 are separated by a first dielectric material 14 which fills the space therebetween. And the second planar conductor strip 15 and a third planar conductor strip 16 are separated by a second dielectric material 17 which fills the space therebetween. Preferably, the separation produced by the dielectric materials positions the planar conductor strips 13, 15 and 16 to be parallel with each other as shown. A third dielectric material 19 is also shown connected to and capping the planar conductor strips and dielectric strips 13–17. The third dielectric material 19 serves to combine the waves and allow only a pulsed voltage to be across the vacuum wall, thus reducing the time the stress is applied to that wall and enabling even higher gradients. It can also be used as a region to transform the wave, i.e., step up the voltage, change the impedance, etc. prior to applying it to the accelerator. As such, the third dielectric material 19 and the second end 12 generally, are shown adjacent a load region indicated by arrow 20. In particular, arrow 20 represents an acceleration axis of a particle accelerator and pointing in the direction of particle acceleration. It is appreciated that the direction of acceleration is dependent on the paths of the fast and slow transmission lines, through the two dielectric strips, as discussed in the Background.

Figure 12:
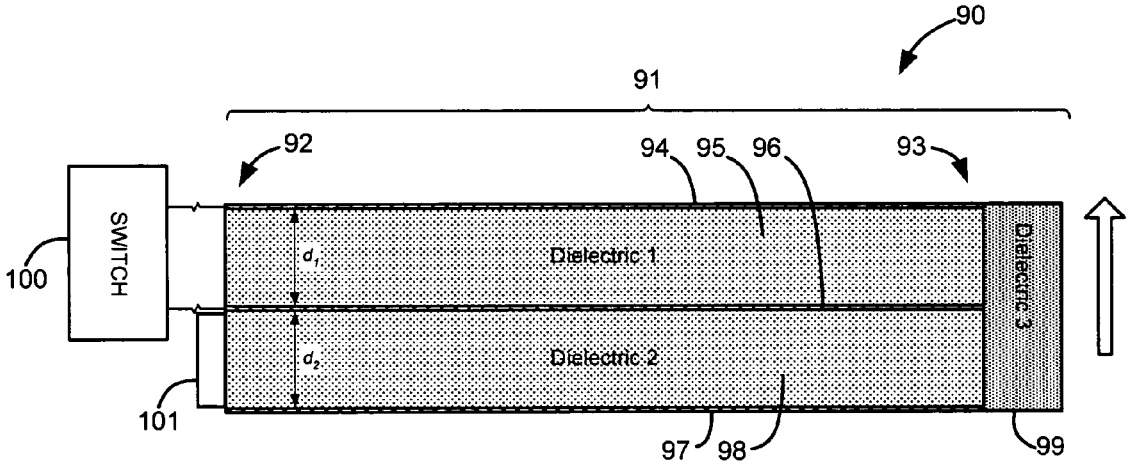
FIG. 12 is a side view of another exemplary embodiment of the present invention similar to FIG. 1, and having the first dielectric strip and the second dielectric strip having the same dielectric constants and the same thicknesses, for symmetric Blumlein operation.

In FIG. 1, the switch 18 is shown connected to the planar conductor strips 13, 15, and 16 at the respective first ends, i.e. at first end 11 of the module 36. The switch serves to initially connect the outer planar conductor strips 13, 16 to a ground potential and the middle conductor strip 15 to a high voltage source (not shown). The switch 18 is then operated to apply a short circuit at the first end so as to initiate a propagating voltage wavefront through the Blumlein module and produce an output pulse at the second end. In particular, the switch 18 can initiate a propagating reverse polarity wavefront in at least one of the dielectrics from the first end to the second end, depending on whether the Blumlein module is configured for symmetric or asymmetric operation. When configured for asymmetric operation, as shown in FIGS. 1 and 2, the Blumlein module comprises different dielectric constants and thicknesses ($d_1 \neq d_2$) for the dielectric layers 14, 17, in a manner similar to that described in Carder. The asymmetric operation of the Blumlein generates different propagating wave velocities through the dielectric layers. However, when the Blumlein module is configured for symmetric operation as shown in FIG. 12, the dielectric strips 95, 98 are of the same dielectric constant, and the width and thickness ($d_1=d_2$) are also the same. In addition, as shown in FIG. 12, a magnetic material is also placed in close proximity to the second dielectric strip 98 such that propagation of the wavefront is inhibited in that strip. In this manner, the switch is adapted to initiate a propagating reverse polarity wavefront in only the first dielectric strip 95. It is appreciated that the switch 18 is a suitable switch for asymmetric or symmetric Blumlein module operation, such as for example, gas discharge closing switches, surface flashover closing switches, solid state switches, photoconductive switches, etc. And it is further appreciated that the choice of switch and dielectric material types/dimensions can be suitably chosen to enable the compact accelerator to operate at various acceleration gradients, including for example gradients in excess of twenty megavolts per meter. However, lower gradients would also be achievable as a matter of design.

In one preferred embodiment, the second planar conductor has a width, $w_1$ defined by characteristic impedance $Z_1=k_1g_1(w_1,d_1)$ through the first dielectric strip. $k_1$ is the first electrical constant of the first dielectric strip defined by the square root of the ratio of permeability to permittivity of the first dielectric material, $g_1$ is the function defined by the geometry effects of the neighboring conductors, and $d_1$ is the thickness of the first dielectric strip. And the second dielectric strip has a thickness defined by characteristic impedance $Z_2=k_2g_2(w_2, d_2)$ through the second dielectric strip. In this case, $k_2$ is the second electrical constant of the second dielectric material, $g_2$ is the function defined by the geometry effects of the neighboring conductors, and $w_2$ is the width of the second planar conductor strip, and $d_2$ is the thickness of the second dielectric strip. In this manner, as differing dielectrics required in the asymmetric Blumlein module result in differing impedances, the impedance can now be hold constant by adjusting the width of the associated line. Thus greater energy transfer to the load will result.

Figure 4:
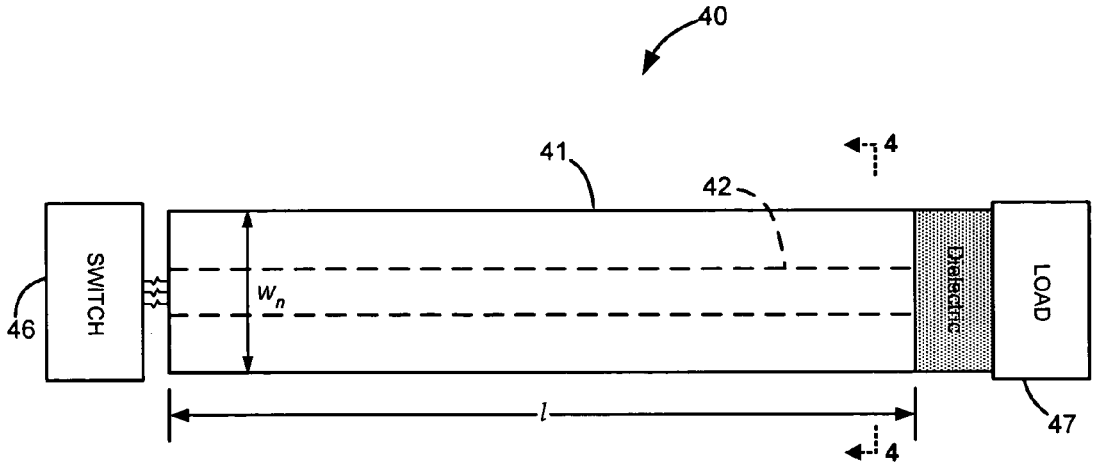
FIG. 4 is a top view of a third exemplary embodiment of a single Blumlein module of the present invention having a middle conductor strip with a smaller width than other layers of the module.
Figure 5:
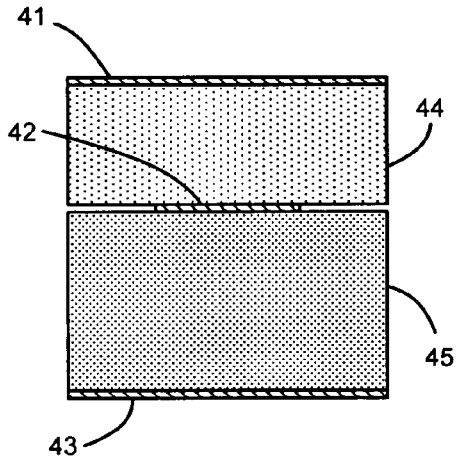
FIG. 5 is an enlarged cross-sectional view taken along line 4 of FIG. 4.

FIGS. 4 and 5 show an exemplary embodiment of the Blumlein module having a second planar conductor strip 42 with a width that is narrower than those of the first and second planar conductor strips 41, 42, as well as first and second dielectric strips 44, 45. In this particular configuration, the destructive layer-to-layer coupling discussed in the Background is inhibited by the extension of electrodes 41 and 43 as electrode 42 can no longer easily couple energy to the previous or subsequent Blumlein. Furthermore, another exemplary embodiment of the module preferably has a width which varies along the lengthwise direction, l, (see FIGS. 2, 4) so as to control and shape the output pulse shape. This is shown in FIG. 6 showing a tapering of the width as the module extends radially inward towards the central load region. And in another preferred embodiment, dielectric materials and dimensions of the Blumlein module are selected such that, $Z_1$ is substantially equal to $Z_2$. As previously discussed, match impedances prevent the formation of waves which would create an oscillatory output.

And preferably, in the asymmetric Blumlein configuration, the second dielectric strip 17 has a substantially lesser propagation velocity than the first dielectric strip 14, such as for example 3:1, where the propagation velocities are defined by $v_2$, and $v_1$, respectively, where $v_2=(\mu_2\epsilon_2)^{-0.5}$ and $v_1=(\mu_1\epsilon_1)^{-0.5}$; the permeability, $\mu_1$, and the permittivity, $\epsilon_1$, are the material constants of the first dielectric material; and the permeability, $\mu_2$, and the permittivity, $\epsilon_2$, are the material constants of the second dielectric material. This can be achieved by selecting for the second dielectric strip a material having a dielectric constant, i.e. $\mu_1\epsilon_1$, which is greater than the dielectric constant of the first dielectric strip, i.e. $\mu_2\epsilon_2$. As shown in FIG. 1, for example, the thickness of the first dielectric strip is indicated as $d_1$, and the thickness of the second dielectric strip is indicated as $d_2$, with $d_2$ shown as being greater than $d_1$. By setting $d_2$ greater than $d_1$, the combination of different spacing and the different dielectric constants results in the same characteristic impedance, Z, on both sides of the second planar conductor strip 15. It is notable that although the characteristic impedance may be the same on both halves, the propagation velocity of signals through each half is not necessarily the same. While the dielectric constants and the thicknesses of the dielectric strips may be suitably chosen to effect different propagating velocities, it is appreciated that the elongated strip-shaped structure and configuration of the present invention need not utilize the asymmetric Blumlein concept, i.e. dielectrics having different dielectric constants and thicknesses. Since the controlled waveform advantages are made possible by the elongated beam-like geometry and configuration of the Blumlein modules of the present invention, and not by the particular method of producing the high acceleration gradient, another exemplary embodiment can employ alternative switching arrangements, such as that discussed for FIG. 12 involving symmetric Blumlein operation.

Figure 3:
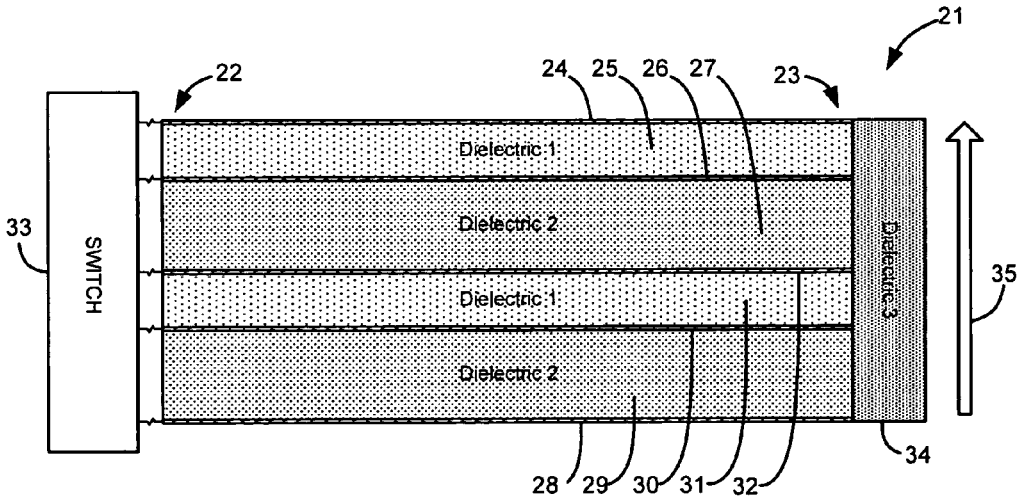
FIG. 3 is a side view of a second exemplary embodiment of the compact accelerator having two Blumlein modules stacked together.

The compact accelerator of the present invention may alternatively be configured to have two or more of the elongated Blumlein modules stacked in alignment with each other. For example, FIG. 3 shows a compact accelerator 21 having two Blumlein modules stacked together in alignment with each other. The two Blumlein modules form an alternating stack of planar conductor strips and dielectric strips 24–32, with the planar conductor strip 32 common to both modules. And the conductor strips are connected at a first end 22 of the stacked module to a switch 33. A dielectric wall is also provided at 34 capping the second end 23 of the stacked module, and adjacent a load region indicated by acceleration axis arrow 35.

Figure 7:
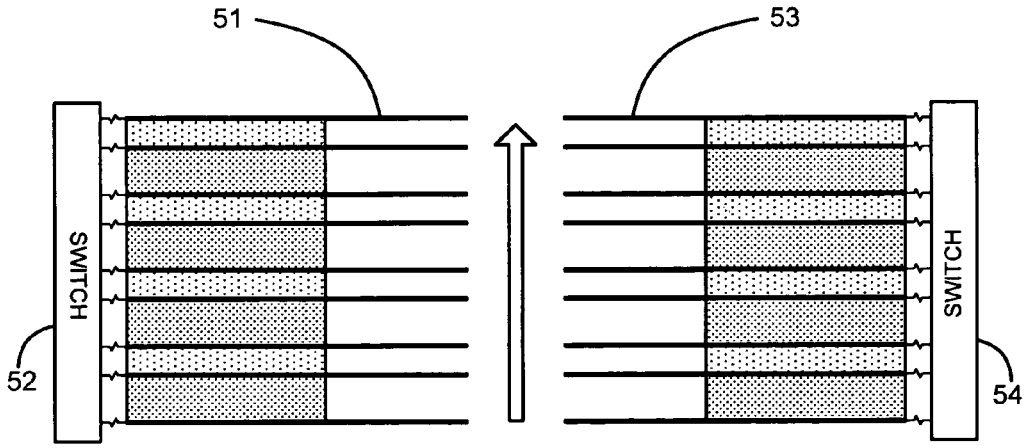
FIG. 7 is a cross-sectional view taken along line 7 of FIG. 6.

The compact accelerator of the present invention may also be configured with at least two Blumlein modules which are positioned to perimetrically surround a central load region. Furthermore, each perimetrically surrounding module may additionally include one ore more additional Blumlein modules stacked to align with the first module. FIG. 6, for example, shows an exemplary embodiment of a compact accelerator 50 having two Blumlein module stacks 51 and 53, with the two stacks surrounding a central load region 56. Each module stack is shown as a stack of four independently operated Blumlein modules (FIG. 7), and is separately connected to associated switches 52, 54. It is appreciated that the stacking of Blumlein modules in alignment with each other increases the coverage of segments along the acceleration axis.

Figure 8:
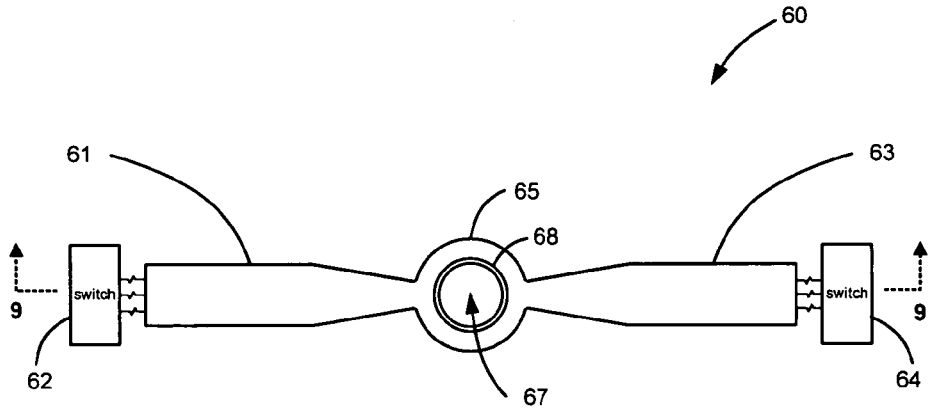
FIG. 8 is a plan view of another exemplary embodiment of the compact accelerator shown with two Blumlein modules perimetrically surrounding and radially extending towards a central acceleration region, with planar conductor strips of one module connected by ring electrodes to corresponding planar conductor strips of the other module.
Figure 9:
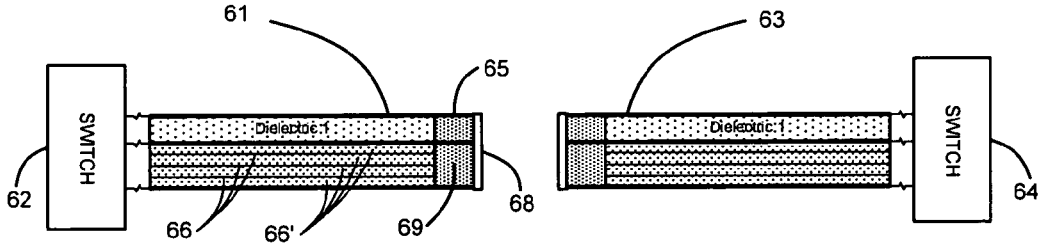
FIG. 9 is a cross-sectional view taken along line 9 of FIG. 8.

In FIGS. 8 and 9 another exemplary embodiment of a compact accelerator is shown at reference character 60, having two or more conductor strips, e.g. 61, 63, connected at their respective second ends by a ring electrode indicated at 65. The ring electrode configuration operates to overcome any azimuthal averaging which may occur in the arrangement of such as FIGS. 6 and 7 where one or more perimetrically surrounding modules extend towards the central load region without completely surrounding it. As best seen in FIG. 9, each module stack represented by 61 and 62 is connected to an associated switch 62 and 64, respectively. Furthermore, FIGS. 8 and 9 show an insulator sleeve 68 placed along an interior diameter of the ring electrode. Alternatively, separate insulator material 69 is also shown placed between the ring electrodes 65. And as an alternative to the dielectric material used between the conductor strips, alternating layers of conducting 66 and insulating 66' foils may be utilized. The alternative layers may be formed as a laminated structure in lieu of a monolithic dielectric strip.

Figure 10:
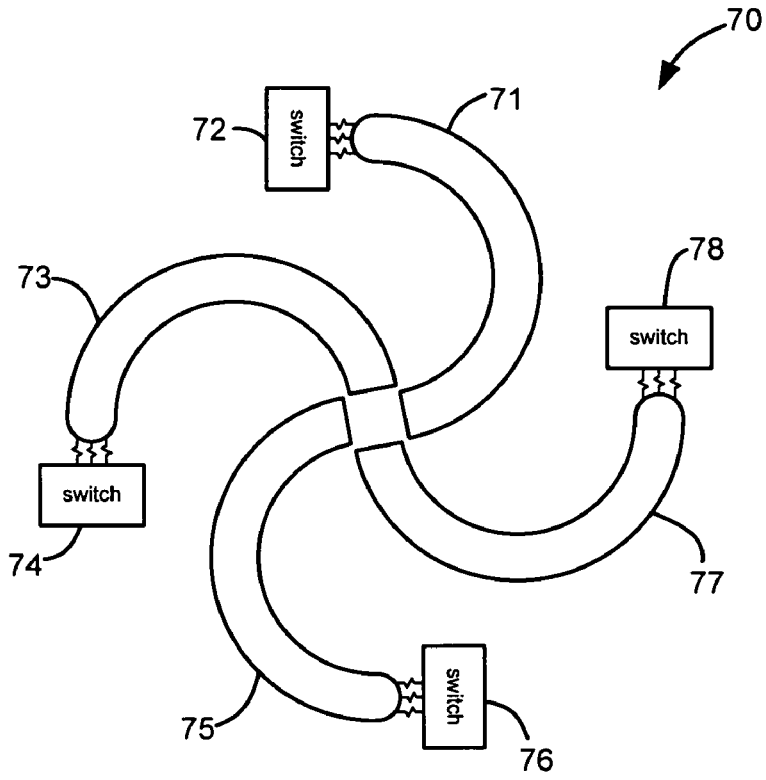
FIG. 10 is a plan view of another exemplary embodiment of the present invention having four non-linear Blumlein modules each connected to an associated switch.
Figure 11:
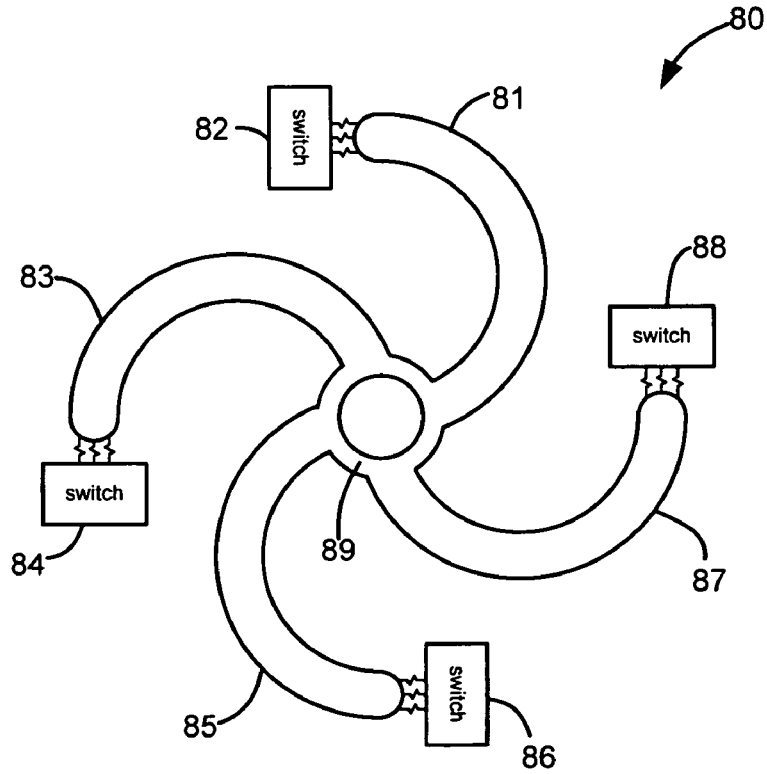
FIG. 11 is a plan view of another exemplary embodiment of the present invention similar to FIG. 10, and including a ring electrode connecting each of the four non-linear Blumlein modules at respective second ends thereof.

And FIGS. 10 and 11 show two additional exemplary embodiments of the compact accelerator, generally indicated at reference character 70 in FIG. 10, and reference character 80 in FIG. 11, each having Blumlein modules with non-linear strip-shaped configurations. In this case, the non-linear strip-shaped configuration is shown as a curvilinear or serpentine form. In FIG. 10, the accelerator 70 comprises four modules 71, 73, 75, and 77, shown perimetrically surrounding and extending towards a central region. Each module 71, 73, 75, and 77, is connected to an associated switch, 72, 74, 76, and 78, respectively. As can be seen from this arrangement, the direct radial distance between the first and second ends of each module is less than the total length of the non-linear module, which enables compactness of the accelerator while increasing the electrical transmission path. FIG. 11 shows a similar arrangement as in FIG. 10, with the accelerator 80 having four modules 81, 83, 85, and 87, shown perimetrically surrounding and extending towards a central region. Each module 81, 83, 85, and 87, is connected to an associated switch, 82, 84, 86, and 88, respectively. Furthermore, the radially inner ends, i.e. the second ends, of the modules are connected to each other by means of a ring electrode 89, providing the advantages discussed in FIG. 8.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

We claim:

1. A compact linear accelerator, comprising:

a Blumlein module having:

a first planar conductor strip having a first end connected to a ground potential, and a second end adjacent an acceleration axis;

a second planar conductor strip adjacent to and parallel with the first planar conductor strip, said second planar conductor strip having a first end switchable between the ground potential and a high voltage potential and a second end adjacent the acceleration axis;

a third planar conductor strip adjacent to and parallel with the second planar conductor strip, said third planar conductor strip having a first end connected to a ground potential and a second end adjacent the acceleration axis;

a first dielectric strip that fills the space between the first and second planar conductor strips, and comprising a first dielectric material with a first dielectric constant; and a second dielectric strip that fills the space between the second and third planar conductor strips, and comprising a second dielectric material with a second dielectric constant, wherein the strip configuration of the Blumlein module guides an electrical signal wave propagated therethrough from the first end to the second end in order to control an output pulse produced at the second end.

2. The compact linear accelerator of claim 1, further comprising:

high voltage power supply means connected to charge said second planar conductor strip to a high potential; and switching means for switching the high potential in the second planar conductor strip to at least one of the first and third planar conductor strips so as to initiate a propagating reverse polarity wavefront(s) in the corresponding dielectric strip(s).

3. The compact linear accelerator of claim 1, wherein said Blumlein modules has a non-linear, strip-shaped configuration.

4. The compact linear accelerator of claim 1, further comprising at least one additional Blumlein module stacked in alignment with the first module.

5. The compact linear accelerator of claim 1,
further comprising at least one additional Blumlein module, said modules perimetrically surrounding a segment of the acceleration axis, and with each perimetrically surrounding module connected to an associated switching means for initiating a propagating reverse polarity wavefront through the respective module.

6. The compact linear accelerator of claim 5,
further comprising at least one additional Blumlein module stacked in alignment with each of said perimetrically surrounding modules, whereby the additionally stacked modules perimetrically surround adjacent segments of the acceleration axis.

7. The compact linear accelerator of claim 5,
wherein said perimetrically surrounding modules each have a non-linear, strip-shaped configuration.

8. The compact linear accelerator of claim 5,
wherein the first, second, and third planar conductor strips of said perimetrically surrounding modules are connected to corresponding first, second, and third ring electrodes at the respective second ends thereof, said ring electrodes encircling the central region associated with said segment of the acceleration axis.

9. The compact linear accelerator of claim 8,
further comprising an insulator sleeve adjacent an inner diameter of said ring electrodes.

10. The compact linear accelerator of claim 8,
further comprising an insulator sleeve between said ring electrodes.

11. The compact linear accelerator of claim 1,
wherein said second planar conductor strip has a width, $w_1$, defined by the equation $Z_1=k_1g_1(w_1,d_1)$, and the second dielectric strip has a thickness, $d_2$, defined by the equation $Z_2=k_2g_2(w_2, d_2)$.

12. The compact linear accelerator of claim 11,
wherein $Z_1$ is substantially equivalent to $Z_2$.

13. The compact linear accelerator of claim 11,
wherein the width, $w_1$, of the second planar conductor strip is varied along a length, l, thereof, so as to control the output pulse shape.

14. The compact linear accelerator of claim 13,
wherein the width, $w_1$, of the second planar conductor strip narrows toward the second end thereof.

15. The compact linear accelerator of claim 13,
further comprising at least one additional Blumlein module stacked in alignment with the other Blumlein module.

16. The compact linear accelerator of claim 13,
further comprising at least one additional Blumlein module, said modules perimetrically surrounding a segment of the acceleration axis, and with each perimetrically surrounding module connected to an associated switching means for initiating a propagating reverse polarity wavefront through the respective module.

17. The compact linear accelerator of claim 16,
further comprising at least one additional Blumlein module stacked in alignment with each of said perimetrically surrounding modules, whereby the additionally stacked modules perimetrically surround adjacent segments of the acceleration axis.

18. The compact linear accelerator of claim 16,
wherein said perimetrically surrounding modules each have a non-linear, strip-shaped configuration.

19. The compact linear accelerator of claim 16,
wherein said perimetrically surrounding modules are connected to a ring electrode at respective second ends thereof, said ring electrode encircling the central region associated with said segment of the acceleration axis.

20. The compact linear accelerator of claim 19,
further comprising an insulator sleeve adjacent an inner diameter of said ring electrodes.

21. The compact linear accelerator of claim 19,
further comprising an insulator sleeve between the ring electrodes.

22. The compact linear accelerator of claim 1,
wherein at least one dielectric strip comprises a laminated structure having alternating layers of conductive and insulating foils.

23. The compact linear accelerator of claim 13,
wherein at least one dielectric strip comprises a laminated structure having alternating layers of conductive and insulating foils.

24. The compact linear accelerator of claim 1,
further comprising an electromagnetic material adjacent at least one dielectric strip so as to inhibit the propagation of the wavefront in said strip.

25. The compact linear accelerator of claim 13,
further comprising an electromagnetic material adjacent at least one dielectric strip so as to inhibit the propagation of the wavefront in said strip.

26. A compact linear accelerator, comprising:
a Blumlein module having:
a first planar conductor strip having a first end connected to a ground potential, and a second end adjacent an acceleration axis;
a second planar conductor strip adjacent to and parallel with the first planar conductor strip, said second planar conductor strip having a first end switchable between the ground potential and a high voltage potential and a second end adjacent the acceleration axis;
a third planar conductor strip adjacent to and parallel with the second planar conductor strip, said third planar conductor strip having a first end connected to a ground potential and a second end adjacent the acceleration axis;
a first dielectric strip that fills the space between the first and second planar conductor strips, and comprising a first dielectric material with a first dielectric constant; and
a second dielectric strip that fills the space between the second and third planar conductor strips, and comprising a second dielectric material with a second dielectric constant;
high voltage power supply means connected to charge said second planar conductor strip to a high potential; and
switching means for switching the high potential in the second planar conductor strip to at least one of the first and third planar conductor strips so as to initiate a propagating reverse polarity wavefront(s) in the corresponding dielectric strip(s),
wherein the strip configuration of the Blumlein module guides an electrical signal wave propagated therethrough from the first end to the second end in order to control an output pulse produced at the second end.

* * * * *